US006233900B1

(12) United States Patent
Gill

(10) Patent No.: US 6,233,900 B1
(45) Date of Patent: May 22, 2001

(54) PARTITION CLAMPING DEVICE

(76) Inventor: Larnell Gill, 4081 Bairnsdale Way, Sacramento, CA (US) 95826

( * ) Notice: Subject to any disclaimer, the term of this patent is extended or adjusted under 35 U.S.C. 154(b) by 0 days.

(21) Appl. No.: 09/335,164

(22) Filed: Jun. 17, 1999

(51) Int. Cl.[7] ..... E04B 2/74; B25B 1/02; B25B 1/20

(52) U.S. Cl. ..... 52/749.1; 52/127.2; 52/584.1; 52/DIG. 1; 269/152; 269/155; 269/226; 269/904

(58) Field of Search ..... 52/127.2, 584.1, 52/749.1, DIG. 1; 269/152, 155, 226, 904

(56) References Cited

U.S. PATENT DOCUMENTS 3,861,662 * 1/1975 Morse ..... 269/152 X
4,165,869 * 8/1979 Williams ..... 269/155 X
4,984,775 * 1/1991 Kahlke ..... 269/155 X
5,271,194 * 12/1993 Drew ..... 52/127.2 X

* cited by examiner

*Primary Examiner*—Christopher T. Kent

(57) ABSTRACT

A partition clamping device for holding partitions, such as cubical partition walls, in place with one another when assembling the partitions during installation. The partition clamping device includes first and second clamp members each comprising a cross brace and a spaced apart first and second side braces coupled to the cross brace. A threaded rod is threadingly extended through a first of the side braces towards the second side brace. A plate is coupled to an inner end of the threaded rod. The cross braces of the clamp members each have a bore therethrough through which an elongate pole is extended.

15 Claims, 3 Drawing Sheets

PARTITION CLAMPING DEVICE

BACKGROUND OF THE INVENTION

1. Field of the Invention

The present invention relates to clamping device for holding partitions in place with one another and more particularly pertains to a new partition clamping device for holding partitions, such as cubical partition walls, in place with one another when assembling the partitions during installation.

2. Description of the Prior Art

The use of clamping device for holding partitions in place with one another is known in the prior art. More specifically, clamping device for holding partitions in place with one another heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 4,828,239 by Grandy et al.; U.S. Pat. No. 3,807,720 by Converse et al.; U.S. Pat. No. 4,141,192 by Augustine; U.S. Pat. No. 5,048,806 by Deustsch; U.S. Pat. No. 3,284,050 by Meyer; and U.S. Pat. No. 3,357,464 by Vroman.

While these devices fulfill their respective, particular objectives and requirements, the aforementioned patents do not disclose a new partition clamping device. The inventive device includes first and second clamp members each comprising a cross brace and a spaced apart first and second side braces coupled to the cross brace. A threaded rod is threadingly extended through a first of the side braces towards the second side brace. A plate is coupled to an inner end of the threaded rod. The cross braces of the clamp members each have a bore therethrough through which an elongate pole is extended.

In these respects, the partition clamping device according to the present invention substantially departs from the conventional concepts and designs of the prior art, and in so doing provides an apparatus primarily developed for the purpose of holding partitions, such as cubical partition walls, in place with one another when assembling the partitions during installation.

SUMMARY OF THE INVENTION

In view of the foregoing disadvantages inherent in the known types of clamping device for holding partitions in place with one another now present in the prior art, the present invention provides a new partition clamping device construction wherein the same can be utilized for holding partitions, such as cubical partition walls, in place with one another when assembling the partitions during installation.

The general purpose of the present invention, which will be described subsequently in greater detail, is to provide a new partition clamping device apparatus and method which has many of the advantages of the clamping device for holding partitions in place with one another mentioned heretofore and many novel features that result in a new partition clamping device which is not anticipated, rendered obvious, suggested, or even implied by any of the prior art clamping device for holding partitions in place with one another, either alone or in any combination thereof.

To attain this, the present invention generally comprises first and second clamp members each comprising a cross brace and a spaced apart first and second side braces coupled to the cross brace. A threaded rod is threadingly extended through a first of the side braces towards the second side brace. A plate is coupled to an inner end of the threaded rod. The cross braces of the clamp members each have a bore therethrough through which an elongate pole is extended.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new partition clamping device apparatus and method which has many of the advantages of the clamping device for holding partitions in place with one another mentioned heretofore and many novel features that result in a new partition clamping device which is not anticipated, rendered obvious, suggested, or even implied by any of the prior art clamping device for holding partitions in place with one another, either alone or in any combination thereof.

It is another object of the present invention to provide a new partition clamping device which may be easily and efficiently manufactured and marketed.

It is a further object of the present invention to provide a new partition clamping device which is of a durable and reliable construction.

An even further object of the present invention is to provide a new partition clamping device which is susceptible of a low cost of manufacture with regard to both materials and labor, and which accordingly is then susceptible of low prices of sale to the consuming public, thereby making such partition clamping device economically available to the buying public.

Still yet another object of the present invention is to provide a new partition clamping device which provides in the apparatuses and methods of the prior art some of the advantages thereof, while simultaneously overcoming some of the disadvantages normally associated therewith.

Still another object of the present invention is to provide a new partition clamping device for holding partitions, such as cubical partition walls, in place with one another when assembling the partitions during installation.

Yet another object of the present invention is to provide a new partition clamping device which includes first and second clamp members each comprising a cross brace and a spaced apart first and second side braces coupled to the cross brace. A threaded rod is threadingly extended through a first of the side braces towards the second side brace. A plate is coupled to an inner end of the threaded rod. The cross braces of the clamp members each have a bore therethrough through which an elongate pole is extended.

Still yet another object of the present invention is to provide a new partition clamping device that lets a single user install partitions by holding adjacent partitions in a fixed position to one another so that the user may fasten the partitions together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
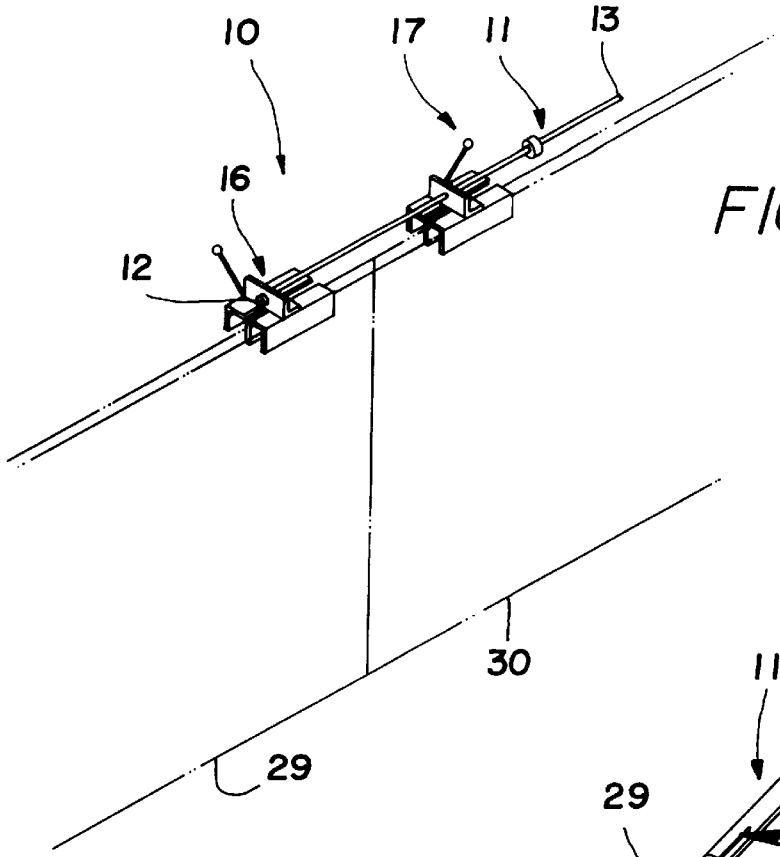
FIG. 1 is a schematic perspective view of a new partition clamping device in use holding two partition structures together according to the present invention.
Figure 2:
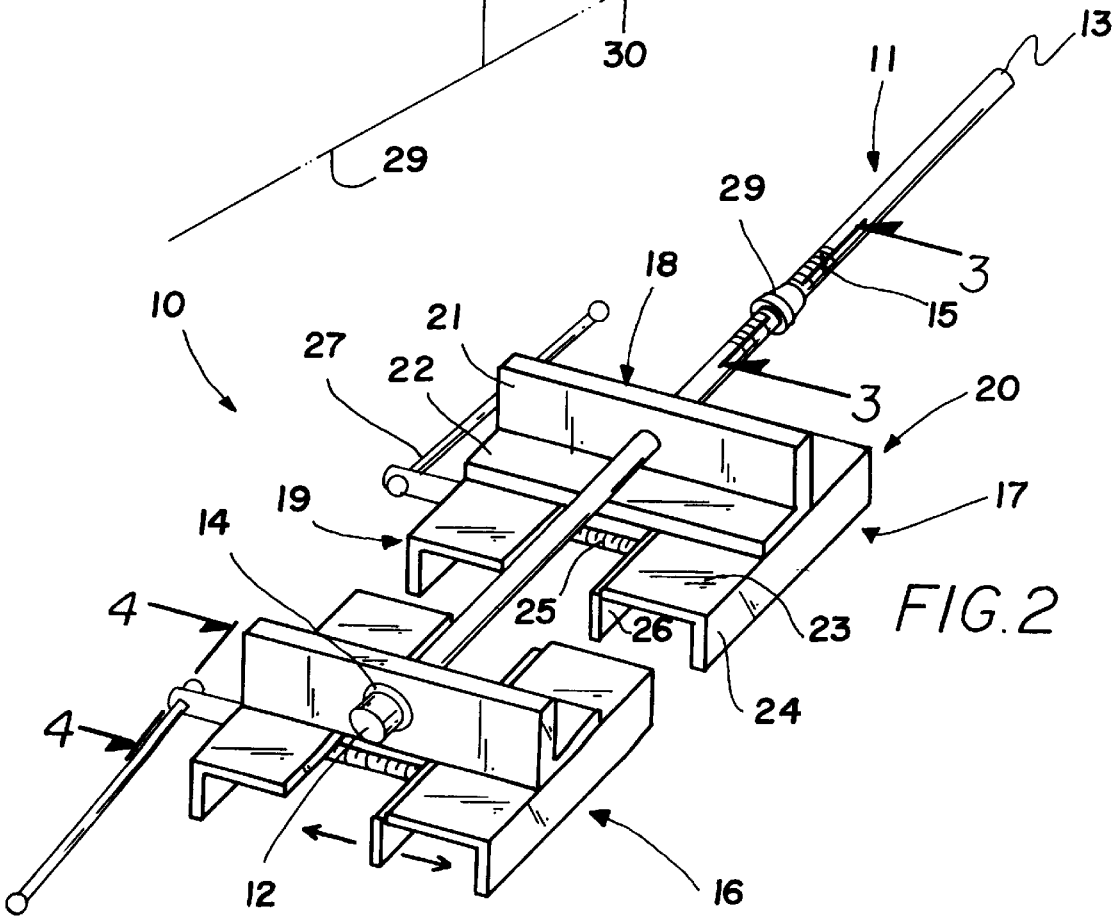
FIG. 2 is a schematic perspective view of the present invention.
Figure 3:
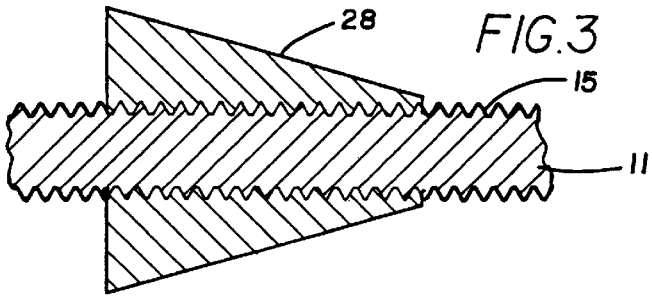
FIG. 3 is a schematic cross sectional view of the present invention taken from line 3—3 of FIG. 2.
Figure 4:
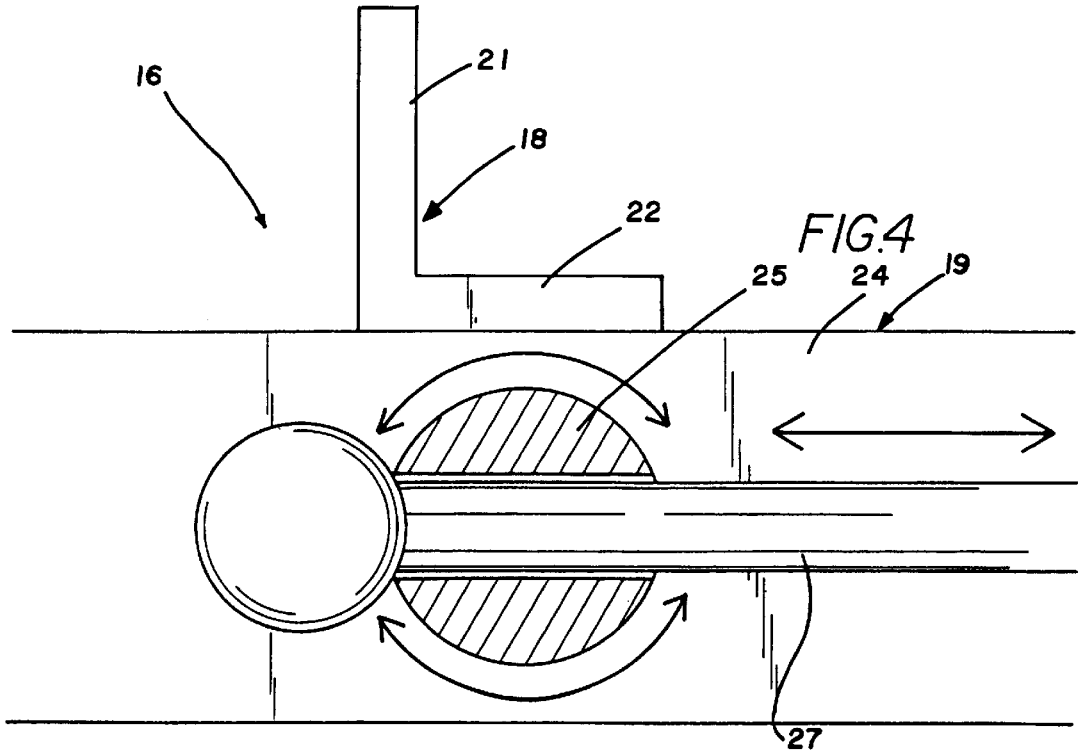
FIG. 4 is a schematic cross sectional view of the present invention taken from line 4—4 of FIG. 2.
Figure 5:
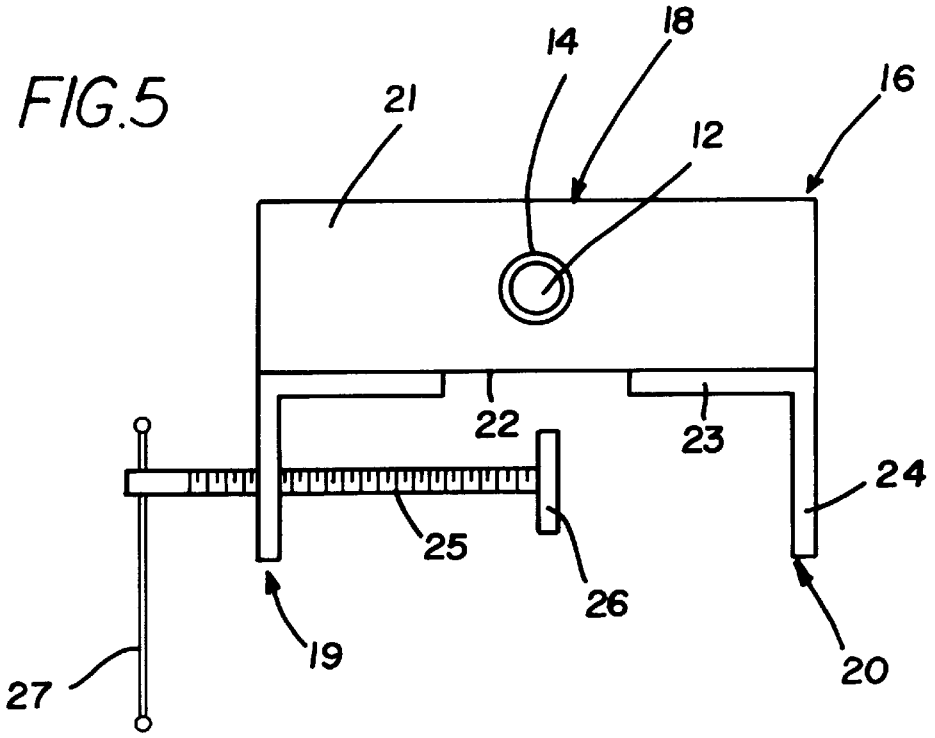
FIG. 5 is a schematic end view of the present invention.

With reference now to the drawings, and in particular to FIGS. 1 through 6 thereof, a new partition clamping device embodying the principles and concepts of the present invention and generally designated by the reference numeral 10 will be described.

As best illustrated in FIGS. 1 through 6, the partition clamping device 10 generally comprises first and second clamp members each comprising a cross brace and a spaced apart first and second side braces coupled to the cross brace. A threaded rod is threadingly extended through a first of the side braces towards the second side brace. A plate is coupled to an inner end of the threaded rod. The cross braces of the clamp members each have a bore therethrough through which an elongate pole is extended.

In closer detail, the clamping device 10 comprises an elongate pole 11 has a pair of opposite ends 12,13 and a longitudinal axis extending between the ends of the pole. The pole preferably has a generally circular transverse cross section taken substantially perpendicular to the longitudinal axis of the pole. The pole has a butt 14 at a first of the ends 12 of the pole. The butt has a diameter greater than the diameter of the pole. The pole has a threaded region 15 positioned towards a second of the ends 13 of the pole and spaced apart from the first end of the pole.

First and second clamp members 16,17 are provided each comprising a cross brace 18 and a spaced apart pair of parallel side braces 19,20. The cross brace is generally L-shaped and has a pair of opposite ends, a longitudinal axis extending between the ends of the cross brace, a generally vertical upper portion 21 and a generally horizontal lower portion 22. The upper portions of the cross portion is extended substantially perpendicular to the lower portion of the cross portion.

Each of the side braces is generally an inverted L-shaped and has a pair of opposite ends, a longitudinal axis extending between the ends of the respective side brace, a generally horizontal top portion 23, and a generally vertical bottom portion 24. The top portions of the side braces are extended substantially perpendicular to the bottom portion of the respective side brace. The top portions of the side braces are coupled to the lower portion of the cross portion. The cross portion is positioned on each side brace between the ends of each side brace. Preferably, the cross portion is about equidistantly spaced apart from the ends of each of the side braces. A first of the side braces 19 is preferably positioned adjacent one of the ends of the cross portion and a second of the side braces 20 is positioned adjacent the other end of the cross portion. Preferably, the longitudinal axes of the side braces are extended substantially parallel to one another and the longitudinal axis of the cross portion is extended substantially perpendicular to the longitudinal axes of the side braces. Ideally, one of the ends of each side brace lie in a common plane with one another and the other of the ends of each side brace lie in a common plane with one another.

The bottom portion of the first side brace has a threaded rod 25 threadingly extended therethrough to permit rotation of the threaded rod in the bottom portion of the first side brace. The threaded rod of the first side brace has opposite inner and outer ends and an axis extending between the inner and outer ends of the threaded rod. The inner end of the threaded rod is extended towards the second side brace and the outer end of the threaded rod is outwardly extended from the first side brace in an opposite direction from the inner end of the threaded rod. Preferably, the axis of the threaded rod is extended substantially perpendicular to the longitudinal axis of the first side brace.

A generally rectangular and substantially planar plate 26 is coupled to the inner end of the threaded rod. The plate and the bottom portion of the second side brace preferably lie in substantially parallel planes to one another. In use, rotation of the threaded rod in a first direction advances the plate towards the bottom portion of the second side brace while rotation of the threaded rod in a second direction retracts the plate away from the bottom portion of the second side brace. An elongate turning handle 27 is slidingly extended through the outer end of the threaded rod substantially perpendicular to the axis of the threaded rod. In use, the turning handle is designed for grasping by a user to rotate the threaded rod to advance and retract the plate.

The cross brace of each clamping member has a generally cylindrical bore therethrough. The bore of each cross brace is preferably generally equidistantly positioned between the ends of the cross brace. The pole is extended through the bores of the cross braces of the first and second clamp members to permit sliding of the first and second clamp members along the length of the pole. The longitudinal axes of the cross braces of the first and second clamp members are preferably extended substantially perpendicular to the longitudinal axis of the pole. Also preferably, the longitudinal axes of the side braces of the first and second clamp members are extended substantially parallel to the longitudinal axis of the pole. In this preferred embodiment, the plates and the bottom portions of the side braces of the first and second clamp member lie in generally parallel planes to one another.

The first clamp member is positioned adjacent the butt of the first end of the pole such that the butt of the pole is positioned between the first end of the pole and the first clamp member. The butt of the pole has a diameter greater than the diameter of the bore of the cross brace of the first clamp member to prevent sliding of the first clamp member off of the first end of the pole. The second clamp member is positioned on the pole between the first clamp member and the threaded region of the pole. A threaded collar 28 is disposed around the pole and threaded on to the threaded region of the pole such that the first and second clamp members are interposed between the butt and threaded collar. The threaded collar has a diameter greater than the diameter of the bore of the cross portion such that the second clamp member cannot slide off of the second end of the pole.

In use, the clamping device is designed for holding a pair of vertical partition structures 29,30 such as cubical wall partitions adjacent one another, the partition clamping device system comprising. In particular, each of the partition structures has a generally horizontally extending upper edge and a generally vertically extending side edge. The side edges of the partition structures are first positioned adjacent one another. The clamping device is then position over the partition structures so that the upper edge of the first partition structure is positioned between the plate and the bottom portion of the second side brace of the first clamp member such that the first partition is clamped between the plate and the bottom portion of the second side brace of the first clamp member to hold the first clamp member to the first partition structure. The upper edge of the second partition structure is positioned between the plate and the bottom portion of the second side brace of the second clamp member such that the second partition is clamped between the plate and the bottom portion of the second side brace of the second clamp member to hold the second clamp member to the second partition structure. Preferably, the top portion of the second side brace of the first clamp member is rested on the upper edge of the first partition structure and the top portion of the second side brace of the second clamp member is rested on the upper edge of the second partition structure. The clamping of the two partition structures with the clamping device permits a single user to fasten the partition structures together with fasteners without the need of a second person holding the partition structures in place.

Figure 6:
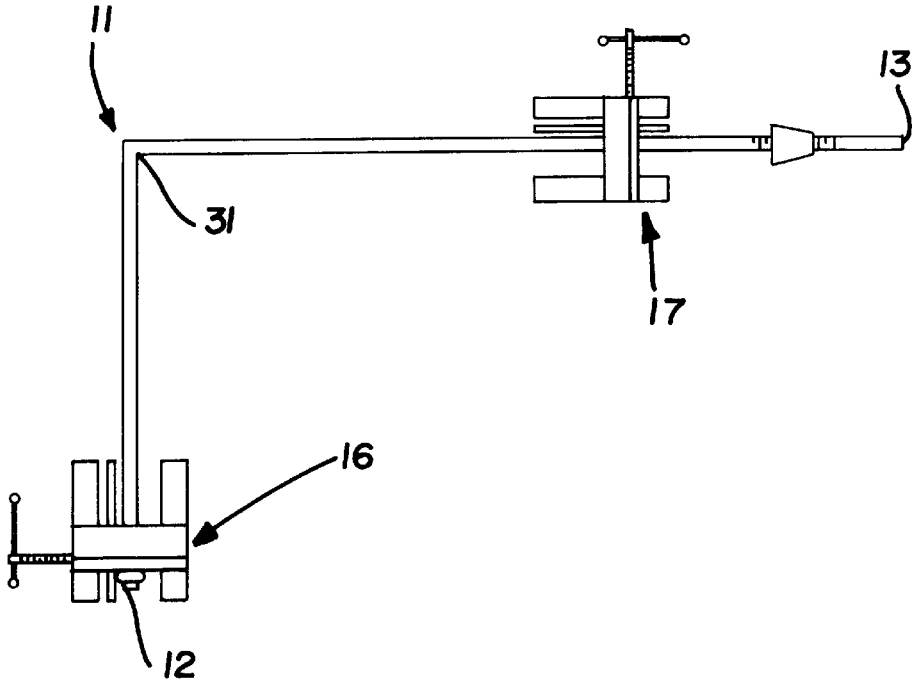
FIG. 6 is a schematic top view of an optional embodiment of the present invention.

Optionally, as illustrated in FIG. 6, the pole may have a bend 31 between the ends of the pole dividing the pole into a pair of elongate portions. A first of the elongate portions of the pole is positioned adjacent the first end of the pole and a second of the elongate portions of the pole is positioned adjacent the second end of the pole. Preferably, the elongate portions of the pole are extended substantially perpendicular to one another for clamping adjacent partition structures at right angles to one another. The threaded region of the pole is positioned one the second elongate portion of the pole. In this embodiment, the first clamp member is positioned on the first elongate portion of the pole and the second clamp is positioned on the second elongate portion of the pole.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A partition clamping device system, comprising;

an elongate pole having opposite first and second ends first and second clamp members each comprising:

a cross brace and a spaced apart first and second side braces;

said cross brace being generally L-shaped and having a pair of opposite ends, a longitudinal axis extending between said ends of said cross brace, and upper and lower portions;

each of said side braces being generally L-shaped and having a pair of opposite ends, a longitudinal axis extending between said ends of the respective side brace, and top and bottom portions;

said top portions of said side braces being coupled to said lower portion of said cross brace;

said bottom portion of said first side brace having a threaded rod being threadingly extended therethrough, said threaded rod of said first side brace having opposite inner and outer ends and an axis extending between said inner and outer ends of said threaded rod;

said inner end of said threaded rod being extended towards said second side brace, said outer end of said threaded rod being outwardly extended from said first side brace;

a plate being coupled to said inner end of said threaded rod;

said cross brace having a bore therethrough; and said pole being extended through said bores of said cross braces of said first and second clamp members; and wherein said pole has a threaded region interposed between said second clamp member and said second end of said pole, wherein a threaded collar is disposed around said pole and threaded on to said threaded region of said pole.

2. The partition clamping device system of claim 1, wherein said pole has a butt at said first end of said pole, said butt of said pole being interposed between said first end of said pole and said first clamping member.

3. The partition clamping device system of claim 1, wherein said longitudinal axes of said side braces are extended substantially parallel to one another, and wherein said longitudinal axis of said cross brace is extended substantially perpendicular to said longitudinal axes of said side braces.

4. The partition clamping device system of claim 1, wherein said plate and said bottom portion of said second side brace lie in substantially parallel planes to one another.

5. The partition clamping device system of claim 1, further comprising an elongate turning handle being slidingly extended through said outer end of said threaded rod.

6. The partition clamping device system of claim 1, wherein said pole has a bend between said ends of said pole dividing said pole into a pair of elongate portions, a first of said elongate portions of said pole being positioned adjacent said first end of said pole, a second of said elongate portions of said pole being positioned adjacent said second end of said pole.

7. The partition clamping device system of claim 6, wherein said elongate portions of said pole are extended substantially perpendicular to one another.

8. A partition clamping device system; comprising:

a pair of vertically extending partition structures each having a generally horizontally extending upper edge and a generally vertically extending side edge, said side edges of said partition structures being positioned adjacent one another;

an elongate pole having a pair of opposite ends, said pole having a generally circular transverse cross section taken substantially perpendicular to said longitudinal axis of said pole;

said pole having a butt at a first of said ends of said pole;

said pole having a threaded region positioned towards a second of said ends of said pole and spaced apart from said first end of said pole;

first and second clamp members each comprising:

a cross brace and a spaced apart pair of side braces;

said cross brace being generally L-shaped and having a pair of opposite ends, a longitudinal axis extending between said ends of said cross brace, an upper portion and a lower portion;

said upper portions of said cross brace being extended substantially perpendicular to said lower portion of said cross brace;

each of said side braces being generally L-shaped and having a pair of opposite ends, a longitudinal axis extending between said ends of the respective side brace, a top portion, and a bottom portion;

said top portions of said side braces being extended substantially perpendicular to said bottom portion of the respective side brace;

said top portions of said side braces being coupled to said lower portion of said cross brace, said cross brace being positioned on each side brace between said ends of each side brace, wherein said cross brace is about equidistantly spaced apart from said ends of each of said side braces;

a first of said side braces being positioned adjacent one of said ends of said cross brace, a second of said side braces being positioned adjacent the other end of said cross brace;

said longitudinal axes of said side braces being extended substantially parallel to one another, said longitudinal axis of said cross brace being extended substantially perpendicular to said longitudinal axes of said side braces;

one of said ends of each side brace lying in a common plane with one another, the other of said ends of each side brace lying in a common plane with one another;

said bottom portion of said first side brace having a threaded rod being threadingly extended therethrough, said threaded rod of said first side brace having opposite inner and outer ends and an axis extending between said inner and outer ends of said threaded rod;

said inner end of said threaded rod being extended towards said second side brace, said outer end of said threaded rod being outwardly extended from said first side brace;

said axis of said threaded rod being extended substantially perpendicular to said longitudinal axis of said first side brace;

a generally rectangular and substantially planar plate being coupled to said inner end of said threaded rod;

said plate and said bottom portion of said second side brace lying in substantially parallel planes to one another;

an elongate turning handle being slidingly extended through said outer end of said threaded rod, said turning handle being extended substantially perpendicular to said axis of said threaded rod; and said cross brace having a generally cylindrical bore therethrough, said bore of said cross brace being generally equidistantly positioned between said ends of said cross brace;

said pole being extended through said bores of said cross braces of said first and second clamp members;

said longitudinal axes of said cross braces of said first and second clamp members being extended substantially perpendicular to said longitudinal axis of said pole;

said plates and said bottom portions of said side braces of said first and second clamp member lying in generally parallel planes to one another;

said first clamp member being positioned adjacent said first end of said pole;

said second clamp member being positioned on said pole between said first clamp member and said threaded region of said pole;

a threaded collar being disposed around said pole and threaded on to said threaded region of said pole such that said first and second clamp members are interposed between said butt and threaded collar;

said upper edge of said first partition structure being positioned between said plate and said bottom portion of said second side brace of said first clamp member such that said first partition is clamped between said plate and said bottom portion of said second side brace of said first clamp member to hold the first clamp member to the first partition structure;

said upper edge of said second partition structure being positioned between said plate and said bottom portion of said second side brace of said second clamp member such that said second partition is clamped between said plate and said bottom portion of said second side brace of said second clamp member to hold the second clamp member to the second partition structure;

said top portion of said second side brace of said first clamp member being rested on said upper edge of said first partition structure; and said top portion of said second side brace of said second clamp member being rested on said upper edge of said second partition structure.

9. The partition clamping system of claim 8, wherein said pole has a bend between said ends of said pole dividing said pole into a pair of elongate portions, a first of said elongate portions of said pole being positioned adjacent said first end of said pole, a second of said elongate portions of said pole being positioned adjacent said second end of said pole, said elongate portions of said pole being extended substantially perpendicular to one another, said threaded region of said pole being positioned one said second elongate portion of said pole, said first clamp member being positioned on said first elongate portion of said pole, said second clamp being positioned on said second elongate portion of said pole.

10. A partition clamping device system, comprising;

an elongate pole having opposite first and second ends;

first and second clamp members each comprising:

a cross brace and a spaced apart first and second side braces;

said cross brace being generally L-shaped and having a pair of opposite ends, a longitudinal axis extending between said ends of said cross brace, and upper and lower portions;

each of said side braces being generally L-shaped and having a pair of opposite ends, a longitudinal axis extending between said ends of the respective side brace, and top and bottom portions;

said top portions of said side braces being coupled to said lower portion of said cross brace;

said bottom portion of said first side brace having a threaded rod being threadingly extended therethrough, said threaded rod of said first side brace having opposite inner and outer ends and an axis extending between said inner and outer ends of said threaded rod;

said inner end of said threaded rod being extended towards said second side brace, said outer end of said threaded rod being outwardly extended from said first side brace;

a plate being coupled to said inner end of said threaded rod;

said cross brace having a bore therethrough; and said pole being extended through said bores of said cross braces of said first and second clamp members; and wherein said pole has a bend between said ends of said pole dividing said pole into a pair of elongate portions, a first of said elongate portions of said pole being positioned adjacent said first end of said pole, a second of said elongate portions of said pole being positioned adjacent said second end of said pole.

11. The partition clamping device system of claim 10, wherein said pole has a butt at said first end of said pole, said butt of said pole being interposed between said first end of said pole and said first clamping member.

12. The partition clamping device system of claim 10, wherein said longitudinal axes of said side braces are extended substantially parallel to one another, and wherein said longitudinal axis of said cross brace is extended substantially perpendicular to said longitudinal axes of said side braces.

13. The partition clamping device system of claim 10, wherein said plate and said bottom portion of said second side brace lie in substantially parallel planes to one another.

14. The partition clamping device system of claim 10, further comprising an elongate turning handle being slidingly extended through said outer end of said threaded rod.

15. The partition clamping device system of claim 6, wherein said elongate portions of said pole are extended substantially perpendicular to one another.

* * * * *